US008811121B2

(12) United States Patent
Balli

(10) Patent No.: US 8,811,121 B2
(45) Date of Patent: Aug. 19, 2014

(54) WATCH WITH AN INTEGRATED CHROMATIC TUNER

(75) Inventor: Fabien Balli, Meinier (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 343 days.

(21) Appl. No.: 13/394,434

(22) PCT Filed: Aug. 27, 2010

(86) PCT No.: PCT/EP2010/062582
§ 371 (c)(1),
(2), (4) Date: May 21, 2012

(87) PCT Pub. No.: WO2011/026798
PCT Pub. Date: Mar. 10, 2011

(65) Prior Publication Data

US 2012/0243379 A1 Sep. 27, 2012

(30) Foreign Application Priority Data

Sep. 7, 2009 (EP) ..... 09169640

(51) Int. Cl.

| | |
|---|---|
| ***G04B 47/00*** | (2006.01) |
| ***G04B 19/04*** | (2006.01) |
| ***G10G 7/02*** | (2006.01) |
| ***G04B 47/06*** | (2006.01) |
| ***G04G 21/00*** | (2010.01) |

(52) U.S. Cl.
CPC ..... *G04B 47/06* (2013.01); *G04B 19/04* (2013.01); *G04G 21/00* (2013.01); *G10G 7/02* (2013.01)
USPC ..... 368/10; 368/80; 368/239; 84/484

(58) Field of Classification Search
CPC ..... G04B 47/06; G04B 19/04; G04G 21/00; G10G 7/02
USPC ..... 368/10, 11, 80, 223, 239; 84/464 R, 484
See application file for complete search history.

(56) References Cited

U.S. PATENT DOCUMENTS

| | | | | |
|---|---|---|---|---|
| 4,368,989 | A * | 1/1983 | Kawashima | 368/74 |
| 4,388,000 | A * | 6/1983 | Hagihira | 368/72 |
| 4,474,480 | A * | 10/1984 | Kato | 368/80 |
| 6,201,769 | B1 * | 3/2001 | Lewis | 368/10 |

FOREIGN PATENT DOCUMENTS

| | | |
|---|---|---|
| JP | 57 22584 | 2/1982 |
| JP | 2 153393 | 6/1990 |
| JP | 6 202625 | 7/1994 |
| JP | 2007 219142 | 8/2007 |

OTHER PUBLICATIONS

International Search Report Issued Oct. 6, 2010 in PCT/EP10/62582 Filed Aug. 27, 2010.

* cited by examiner

*Primary Examiner* — Vit W Miska
(74) *Attorney, Agent, or Firm* — Oblon, Spivak, McClelland, Maier & Neustadt, L.L.P.

(57) ABSTRACT

A portable timepiece includes at least one hand for displaying the minutes and hours and an electronic unit for the chromatic tuning of an instrument. The electronic unit includes an acoustic signal sensor and a means of processing the received electro-acoustic signal. At least one of the hands of the timepiece displays data relative to the received electro-acoustic signal.

11 Claims, 6 Drawing Sheets

WATCH WITH AN INTEGRATED CHROMATIC TUNER

FIELD OF THE INVENTION

The present invention concerns a chromatic tuner for musical instruments, which measures the acoustic frequency produced by the instrument to be tuned, and displays quantities characterising the tuning accuracy in a watch, for example a wristwatch.

STATE OF THE ART

Musical instruments generally require periodic tuning, to ensure that they produce consistent sounds. This is commonly achieved by a technique consisting in using a tuning fork with note A as the fourth octave reference note at 440 Hertz.

In order to ensure that the note is exactly accurate independently of parameters that can distort the characteristics of a tuning fork, such as humidity and temperature, there now exist electronic tuners, which enjoy finer precision for determining the frequency associated with a note. These tuners contain a microphone, which converts the acoustic signal into an electric signal, and a digital display device which indicates the closest note and also the accuracy of said note, according to the detected acoustic signal and the obtained electric signal.

Some tuners are calibrated on a fixed reference frequency, typically 440 Hz; others may, however, be adjusted on a neighbouring frequency to adapt the tone of the instrument to particular acoustic conditions, such as for example, the resonance properties of a building or concert hall.

One drawback of portable electronic chromatic tuners is that they are often relatively large and liable to be forgotten or lost by the musician. Moreover, the information provided on the digital display cannot be read intuitively, particularly with respect to the accuracy of the note and the adjustments, both during the calibrating operation and the actual tuning. There therefore exists a requirement for a chromatic tuner that overcomes the limitations of the prior art.

BRIEF SUMMARY OF THE INVENTION

It is an object of the present invention to propose a chromatic tuner integrated in a portable instrument which is regularly available to musicians.

It is another object of the present invention to propose a chromatic tuner which allows easier reading and adjustment of frequencies obtained during tuning and of the calibration frequency.

These objects are achieved by the invention owing to a portable timepiece having the features of the independent device claim set out below.

These objects are also achieved by the invention via a chromatic tuner display method using the portable timepiece according to the invention.

One advantage of the proposed solution is that it allows a chromatic tuner to be integrated in a watch, which means that musicians who need a tuner do not require separate instruments, and this tool can be almost permanently on hand, as often as the watch containing the tool is worn.

Another advantage of the proposed solution is that it the tuning results can be read more easily owing to the hands of the watch in which the tuner is integrated.

BRIEF DESCRIPTION OF THE DRAWINGS

Example implementations of the invention are given in the description and illustrated in the annexed Figures, in which.

EXAMPLE EMBODIMENTS OF THE INVENTION

The invention concerns a portable timepiece, typically a wristwatch, but for example also a pendant, a fob watch or any other portable time display device, with an integrated chromatic tuner which uses one or more hands of the watch, usually dedicated to the current time display. This timepiece consequently implicitly includes a tuning mode which is distinct from the usual time display mode, and in which at least one of the hands is no longer used for that purpose.

The tuner includes an electronic module for calculating the value of the acoustic frequencies transmitted by the instrument to be tuned, and this value and the accuracy of the frequency with respect to notes of a scale, for example the tempered scale (do, do#, re, re#, mi, fa, fa#, so, so#, la, la#, ti, for which the reference frequency is that from la at 440 Hz) is displayed on the timepiece. The English notation system for the tempered scale gives the note "la" the value A, "ti" the value B, "do" the value C, "re" the value D, "mi" the value E, "fa" the value F and "so" the value G, as will be seen hereinafter in the display devices according to preferred embodiments of the invention. Those skilled in the art will understand that it is possible to envisage adapting the integrated tuner according to the invention to any type of scale (natural, Pythagorean) and any tonic system.

Figure 1:
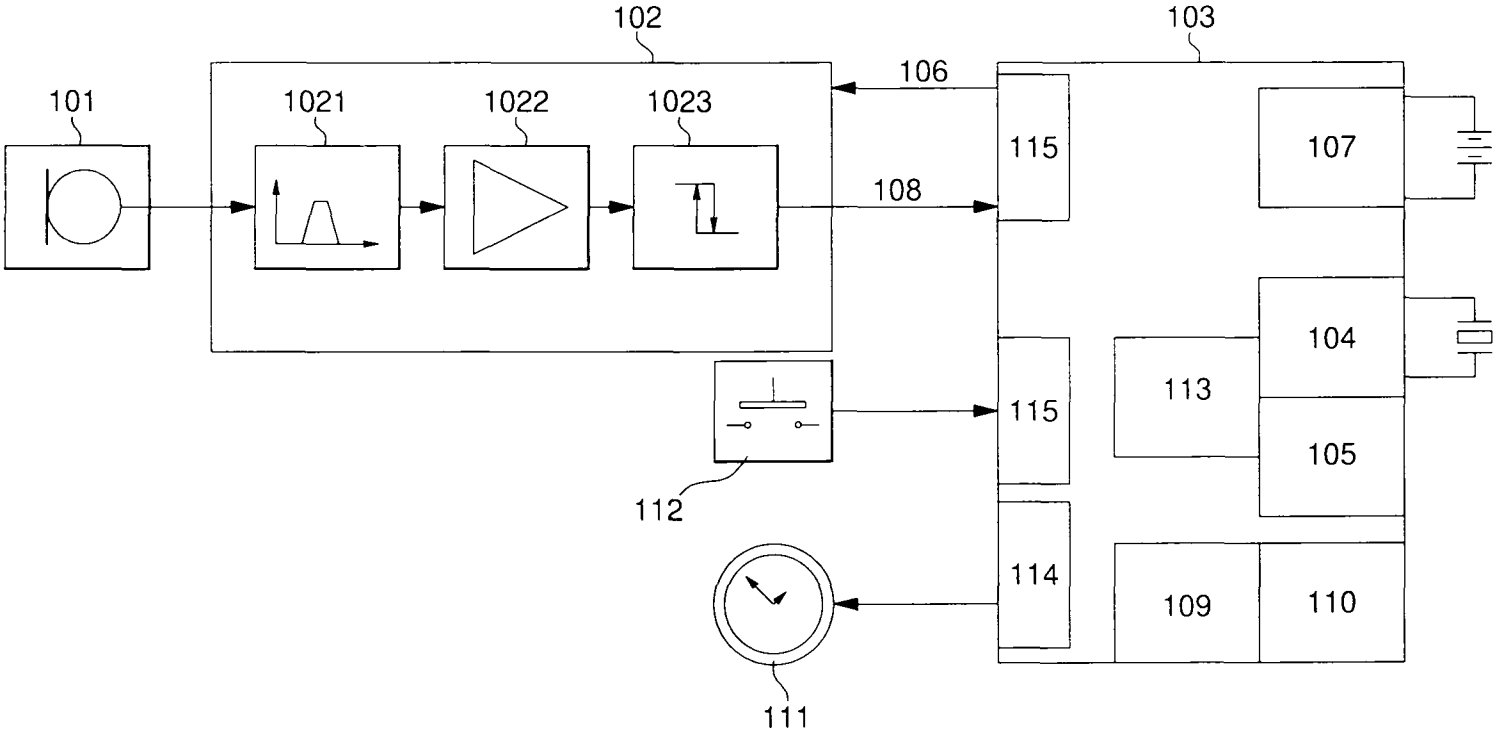
FIG. 1 is a block diagram of the electronic module of the chromatic tuner according to the invention.

FIG. 1 illustrates the logic and operating elements of the electronic device 100 used in a preferred variant of the invention. According to this variant, the electronic device 100 includes firstly an acoustic signal sensor 101, i.e. a microphone, which thus picks up acoustic waves from the external surroundings. The received electro-acoustic signal 10 is then transmitted to signal processing means 102, which transforms the electro-acoustic signal 10 from the microphone into a train of pulses 108, whose changes in state are caused by changes in sign of the electro-acoustic signal 10 from the microphone. The pulse train 108 is thus a binary signal, unlike the electro-acoustic signal 10 which is an analogue signal.

The signal processing means 102 is formed of a filter 1021, which removes frequency components outside a defined signal bandwidth. Signal 10 is then transmitted to an amplifier 1022 and to a comparator 1023, such as, for example, a Schmitt trigger hysteresis comparator.

The pulse train 108 is transmitted to one of the input/output interfaces of a microcontroller 103, which is referenced 115 as a whole for the sake of simplification. Microcontroller 103 has at least one output for delivering a supply current 106 for signal processing means 102, a battery 107, a quartz oscillator 104, typically a 32 KHz oscillator wherein the frequency is temperature compensated, with periodic inhibitory correction. Microcontroller 103 also integrates an RC oscillator 105, preferably a 4 MHz oscillator, which allows the clock of processor 113 of microcontroller 103 to be switched to a faster frequency when long calculations or quick measurements have to be performed, mainly during activation of the tuning function.

Figure 3:
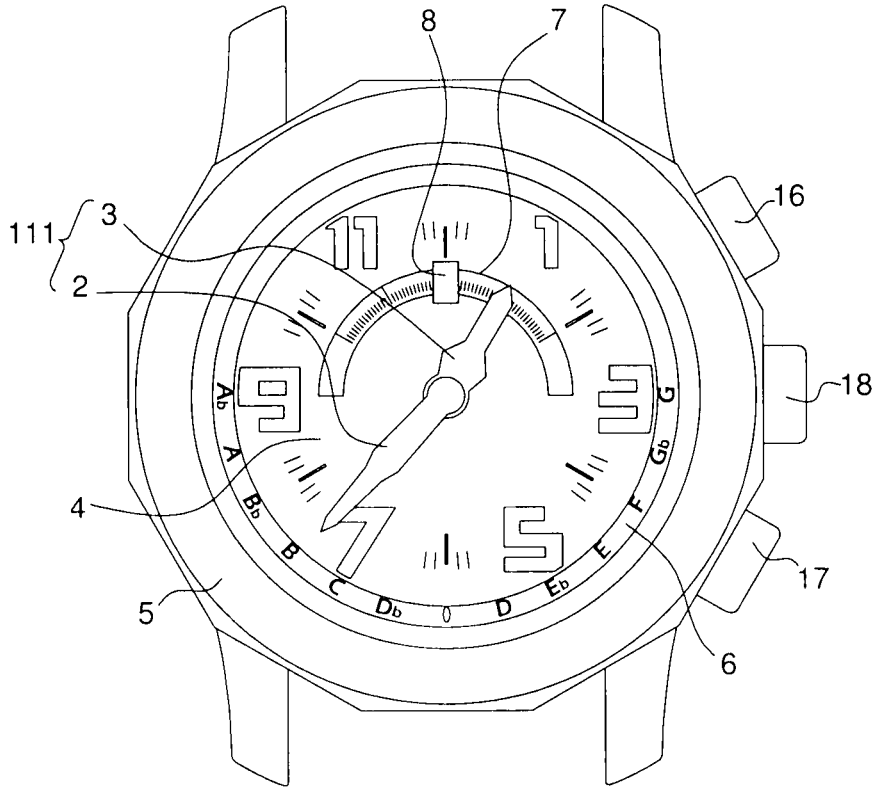
FIG. 3 shows a view of a watch with an integrated chromatic tuner according to a preferred variant of the invention.
Figure 4:
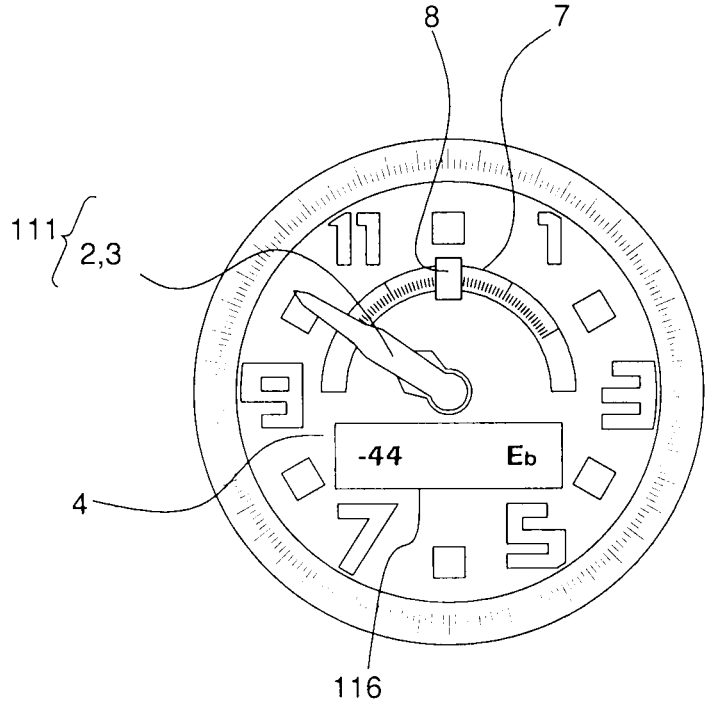
FIG. 4 illustrates the dial of a watch with an integrated chromatic tuner according to another preferred variant of the invention.

As illustrated in FIG. 1, electronic device 100 also includes user interface means 112, which, according to the preferred variants of the invention illustrated in particular in FIGS. 3 and 4, consists, for example, of push buttons (referenced 16, 17, 18 in these Figures). This user interface means 112 may however consist of a stem crown (referenced for example by the number 9 in FIGS. 5 to 7), or a tactile crystal, although this latter variant is not illustrated. This user interface means 112 allows interaction with the user, particularly to request a change of mode, perform adjustments and validate adjustments, as will be seen hereinafter. The interface means interacts on an input/output interface 115 of microcontroller 103.

According to the preferred embodiment illustrated in FIG. 1, the electronic device 100 further includes a motor module 114 formed of at least one bidirectional motor, associated with analogue display means 111. The analogue display means 111 includes at least one independent hand for displaying information about the received signal, the hand being either the hour hand 3 or the minute hand 2, as will be seen hereinafter in FIGS. 3 to 7, which illustrate various display devices according to various embodiments of the invention.

Timepiece 1 with the integrated chromatic tuner according to the invention encompasses totally analogue display systems or hybrid systems with partially digital displays. These embodiments are illustrated respectively in FIGS. 3 and 4 which will be described hereinafter. According to the first display system, motor module 114 of electronic device 100 acts independently on the two hour and minute hands 3 and 2 of the timepiece 1, respectively to provide information about the note identified for electro-acoustic signal 10 and information relating to the accuracy of said note. In the partially digital display system, the note itself is digitally displayed, not using a hand, for example on a liquid crystal screen (LCD), which forms the preferred digital display means. This digital display means is illustrated by the reference 116 in FIG. 4, which illustrates a preferred embodiment of the invention using this hybrid display. This digital display means 116 may however also provide other information, such as accuracy relative to the identified note, and this information may also be corroborated by the presence of one or several hands on watch dial 4 for more intuitive reading.

Figure 2:
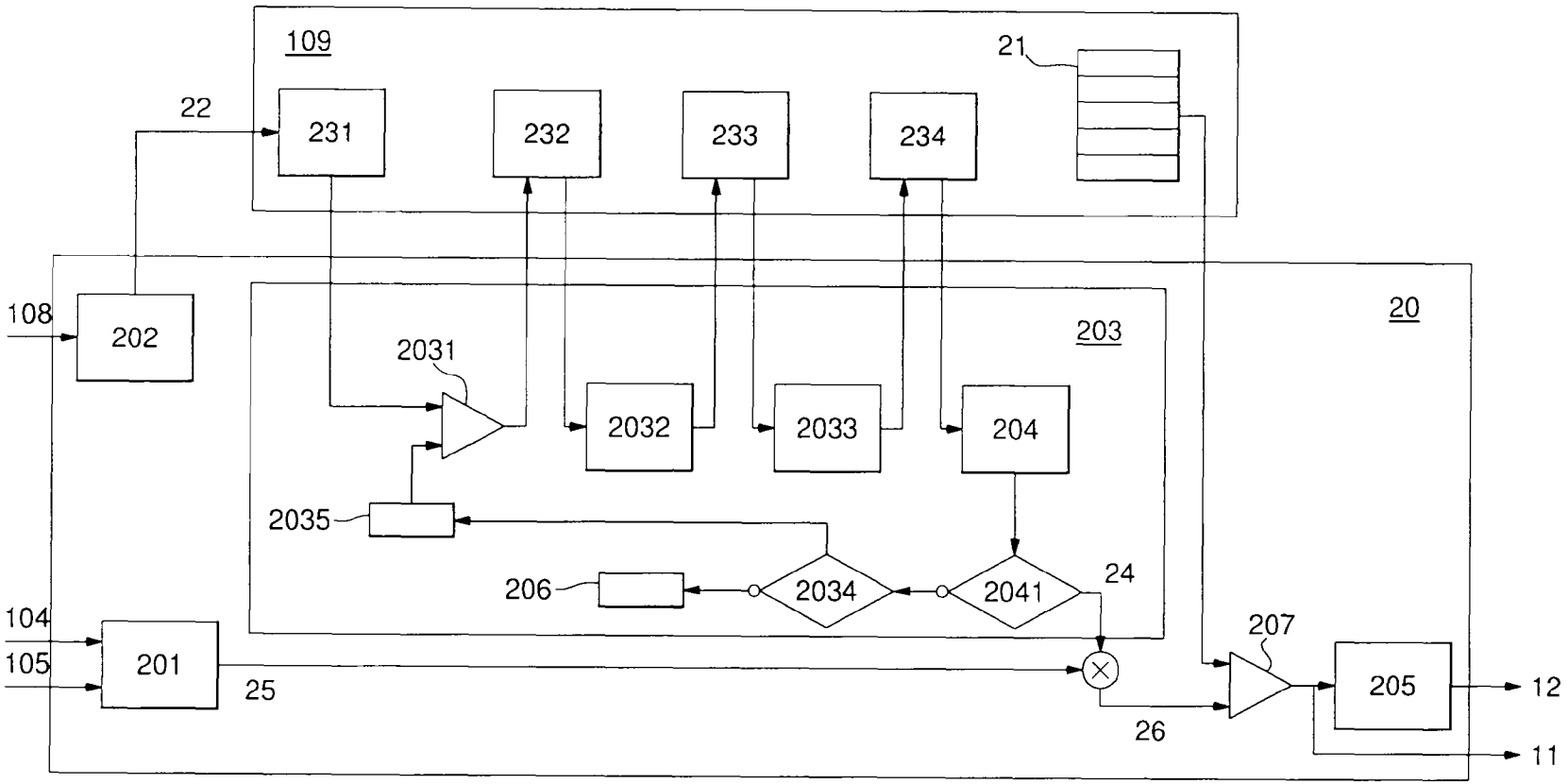
FIG. 2 is a block diagram showing the detection of notes and their accuracy according to the chromatic tuner of the invention.

FIG. 2 illustrates the process 20 of identifying the notes and the accuracy thereof according to a preferred variant of the chromatic tuner of the invention.

According to this preferred embodiment, the RC oscillator 105 is first of all calibrated in a step 201, since the frequency thereof varies in time as a function of the supply voltage and temperature. The calibration consists in counting the number of clock pulses of the RC oscillator 105 within a time window set by the period of a signal derived from the temperature compensated base clock 104. The calibration is performed periodically, for example at 3 and 33 seconds, to ensure stability of the acoustic signal measuring frequency. The correction factor 25 results from the oscillator calibration to compensate for the set frequencies during the note identification process.

Step 202 consists in the microcontroller 103 (not shown in FIG. 2) performing a process of measuring a binary signal 108 obtained at the output of the electro-acoustic signal processing means 102, by counting the time between each rising flank of said signal 102 and storing in series each period of signal 22 in the data memory 109. The periods acquired by the microcontroller form the series 231, which is then compared to a threshold, initially defined for example by the maximum value of series 231, during step 2031. The indices of samples whose value is higher than the threshold then form the reduced series 232, between which the duration between each element is calculated in step 2032. These durations form series 233, which is sorted into ascending order in step 2033 to form series 234.

Step 204 of identifying the fundamental period of electro-acoustic signal 10 is then determined by searching for a periodic relation between the elements of series 234. The process starts from the smallest element of the series then searches for multiples of this element going through the series in ascending order. Each element of the series is divided by ascending integer numbers until the smallest element is reached. As soon as one element of the series comes close to a multiple of this smallest element, then this element is deemed to be the fundamental signal period. If, however, no multiple is found then the process is repeated with the next element of the series until a periodic relation is found in the series. Step 2041 consists in checking whether a fundamental period has actually been found. If so, the result 24 is subjected to the correction factor 25 to give the measured period 26. If not, the threshold used in step 2031 is compared to half the value of the initial threshold, in step 2034, then decremented by a predefined value, for example 10, in step 2035 to determine the new threshold to be used in another repetition of the process of extracting fundamental frequency 203, which will thus repeat all of the preceding steps from 2031 with the new threshold. If the threshold is less than half the initial threshold after step 2034, the fundamental frequency identification process 203 ends at step 206 and no frequency has been identified. The fundamental frequency extraction process 203 has thus failed at step 206.

Once the identified signal period 24 has been delivered by process 203, and the correction has been performed by multiplying by correction factor 25 (illustrated in FIG. 2 by the circled multiplication symbol, designating this multiplication step), the measured period 26 is compared, in step 207, to period values corresponding to musical notes, which are saved in memory 109. This table 21 of musical note values can determine, by comparison, the closest note 11 in a discrete manner. According to a preferred variant, the results of the acoustic signal frequency analysis is displayed at least partially discretely, since the displayed result has to correspond to one of the periods saved in the table 21 of periods corresponding to musical notes. It is, however, also possible according to the invention to display the intrinsic frequency 19 of said received electro-acoustic signal 10 continuously, for example by minute hand 2 opposite a scale of notes 6, as will be seen on the basis of the embodiment illustrated in FIG. 5.

Once the closest note 11 has been identified, the accuracy of the identified period relative to said note still has to be determined. This step 205 consists in determining the relative frequency deviation 12 between note 11 and received signal 10, which can preferably be calculated as follows:

If the acoustic signal frequency is lower than that of the closest note 11, the frequency deviation 12 is equal to the frequency of note 11, less the frequency corresponding to the measured period 26, i.e. the inverse thereof (the frequency is, by definition, equal to the inverse of a period), and the whole divided by the frequency deviation between note 11 and the note immediately below, i.e. in the tempered scale one semitone lower. The whole is then multiplied by 100 to obtain a percentage. For the sake of simplification and legibility of the diagram of FIG. 2, the intrinsic frequency of signal 19, hence equal to the inverse of measured period 26, has not been illustrated.

The same reasoning applies when the acoustic signal frequency is higher than that of the closest note 11, in which case the frequency deviation 12 is measured as the difference between the acoustic signal frequency and the closest note, the whole divided by the difference between the frequency of the note immediately above, i.e. in the tempered scale one semitone higher, and the closest note 11.

With this note accuracy calculation for the tempered scale, those skilled in the art will observe that precision is indicated relative to a frequency deviation of one semitone, since the deviation between the different identifiable notes is always a semitone. It therefore extends from the quarter tone below to the quarter tone above. This precision is preferably indicated by a percentage comprised between −50 and +50%.

FIG. 3 illustrates a preferred embodiment of a timepiece 1 according to the invention, provided with purely analogue means for displaying data in the electro-acoustic signal 10 received by the microphone of the integrated chromatic tuner. Here the timepiece is a wristwatch provided with a minute hand 2 and hour hand 3, which form the analogue display means 111 mentioned above and illustrated in FIG. 1. The watch is also provided with a bezel 5 and a dial 4, at the edge of which there is a scale of notes 6, formed by the notes Ab, A, Bb, B, C, Db, D, Eb, E, F, Gb and G which form the 12 notes of the tempered scale, one for each semitone. The display mode selected in this variant is the flat mode, it is however also possible to envisage the display of all the notes in sharp mode (#), in which case scale 6 would read G#, A, A#, B, C, C#, D, D#, E, F, F#, G. It will be observed that the scale of notes 6 includes a blank indicator 61, which indicates that it has not been possible to identify a note. This indicator 61 will thus be used when step 206, illustrated in FIG. 2, has been performed. It may also be located at a place on dial 4, or bezel 5 independent from that used for the scale of notes 6.

According to the embodiment illustrated in FIG. 3, it will be noted that the scale of notes 6 is arranged opposite minute hand 2, at the periphery of dial 4, on the bottom half of the dial from 3 o'clock to 9 o'clock. The fact of using the larger hand 2 to determine the closest note 11 allows the result to be read quickly and intuitively, while hour hand 3 is used here to give the frequency deviation 12 between the note and the received electro-acoustic signal 10. The display device includes an indicator of the accuracy of the notes 7, formed here by graduations opposite which the hour hand 3 is positioned when the watch is in tuning mode. The indicator displays tone ranging from a quarter tone below to a quarter tone above the closest note 11, and also enables the accuracy to be read intuitively owing to the matching size of hour hand 3, which moves opposite the graduations, which are preferably spread out in the top half of the watch dial, from nine o'clock to three o'clock, to avoid superposing this information on information regarding the pitch of the note. The information regarding the pitch of the closest note 11 and the accuracy of the note are thus totally separate.

It will be noted that the accuracy indication using the hour hand is preferably arranged in the arc of a circle, the angular value of which is preferably slightly less than 180 degrees, preferably around 120 degrees, as illustrated in FIG. 3. Moreover, the maximum deviation percentage values of more or less 50% are indicated inside the arc of a circle formed by the graduations making up indicator 7. It is also possible to make indicator 7 in the form of a scale of colours varying around green which represents a true note, and the edges of which are red to indicate that the sound is false. It is also possible to make this gradual colour indicator in the form of an arc of a circle one end of which is thin, and the other thick, like an eyebrow. The pointed end in this case would preferably indicate a note that was too low, and the thick end of the eyebrow would indicate a note that was too high.

In order to make it easier to read the accuracy of the note, the embodiment of FIG. 3 also illustrates a target zone 8 with respect to the frequency of the closest note 11. This target zone 8, which is, for example, indicated by a very thick scale in a different colour, for example green to indicate accuracy in an intuitive manner, is preferably centred relative to dial 4 and indicates that the acoustic signal frequency is within a range of values sufficiently close to the desired note, for example less than 3%, that no additional tuning is required. This target zone is preferably in the middle of the graduations of note accuracy indicator 7, but could also be outside the arc of a circle formed by the graduations.

Figure 6:
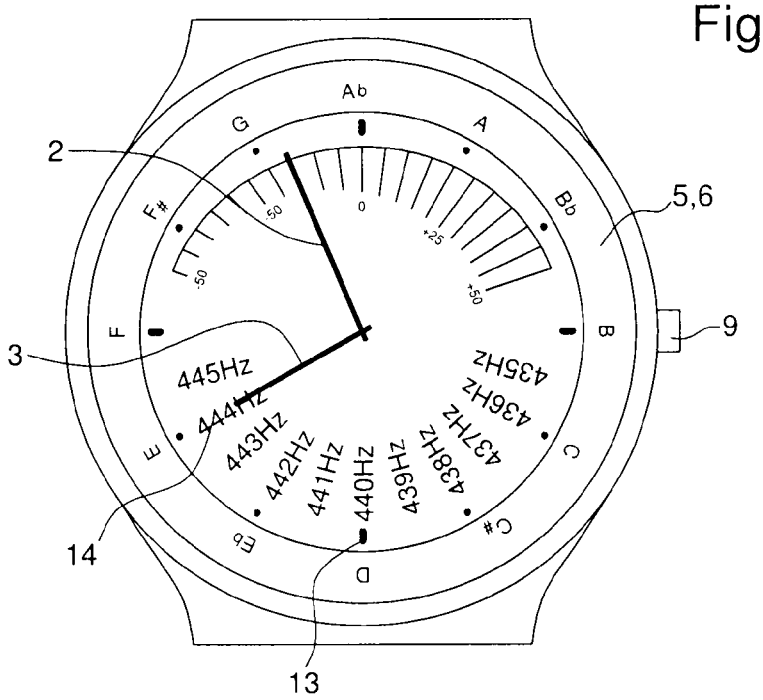
FIG. 6 shows a view of a watch with an integrated chromatic tuner according to another variant of the invention, in which it is possible to calibrate the reference frequency.

The embodiment of FIG. 3 also shows three push buttons: the first 16 being used to increment values and the second to decrement values, such as, for example, the calibration values 14, as will be seen in detail with reference to FIG. 6. The last push button 18 illustrated in FIG. 3 is preferably used for changing mode, particularly for entry into the tuning mode which may, for example, be activated by prolonged pressure of more than two seconds, to prevent the calibration mode from being started inadvertently, on the one hand because it uses the hands and thus prevents the time being simultaneously displayed, and on the other hand, because this mode uses a great deal of energy since the microphone has to be powered and microcontroller 103 has to carry out numerous calculations making heavy use of the base clock or central unit (CPU) 104. This button may also preferably be used for validating adjustments, such as, for example, the values retained for calibration. It is possible to envisage validating entry into tuning mode by positioning the two minute and hour hands on top of each other at midday on watch dial 4.

FIG. 4 illustrates a dial of a timepiece 1 according to the invention, for example a wristwatch, which is provided with hybrid display means, i.e. both digital and analogue. According to this embodiment, the analogue display means 111 is still formed by hour hand 3 and minute hand 2, but this time analogue means 111 is no longer used simply for indicating the accuracy of the notes, i.e. frequency deviation 12 relative to the closest note, while the pitch of the closest note 11 is digitally displayed on an LCD screen, which forms the digital display means 116. This digital display means 116 indicates, in FIG. 4, that the note Eb has been identified. Hands 2 and 3 are superposed and point to the value −44% on the graduations of an indicator 7 located in the top half portion of dial 4. A target zone 8 is located in the middle of the graduations of the indicator, in a similar manner to the analogue embodiment of FIG. 3. Digital display means 116 displays the accuracy data in a redundant manner, here to the left of the indicated note 11. The LCD screen thus replaces not only the scale of notes 6 of the totally analogue variant described previously, but also simultaneously indicates additional or redundant data, regarding the electro-acoustic signal 10 received by signal sensor 101.

According to a variant that is not shown, the additional data indicated by the digital display means 116 could be the pitch, i.e. the reference frequency used for the frequency measurement of the notes, when the latter can be adjusted on a frequency other than the usual A frequency of 440 Hz. Preferably this means is located in the bottom portion of dial 4 below hands 2 and 3 when said hands are used in tuning mode to indicate the accuracy of the closest note 11.

Figure 5:
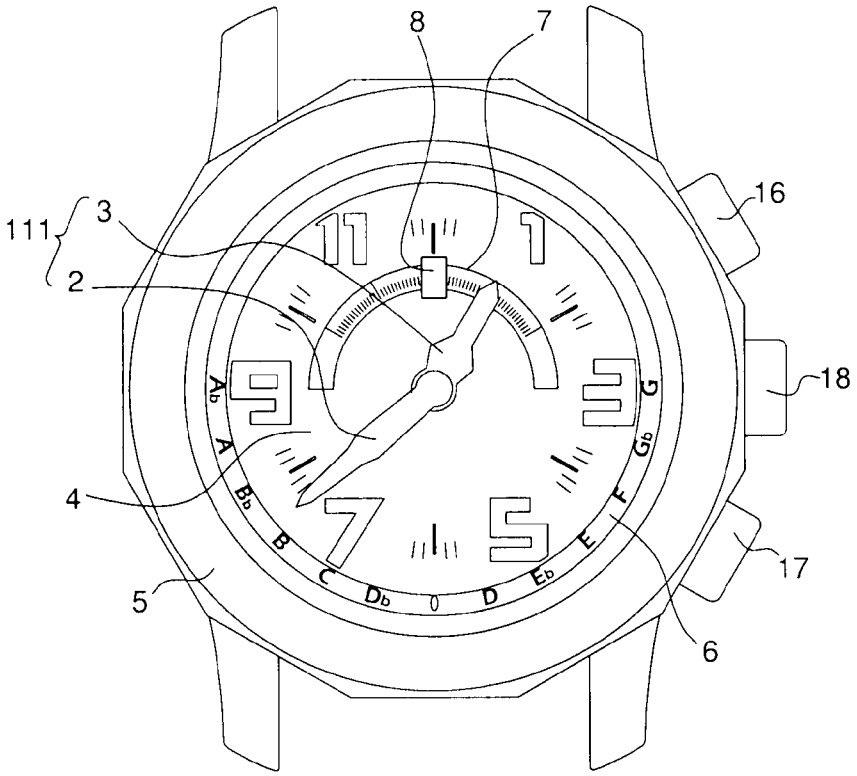
FIG. 5 shows a view of a watch with an integrated chromatic tuner with a display device according to another variant of the invention.

FIG. 5 illustrates a similar embodiment to that of FIG. 3, i.e. wherein the display is totally analogue, performed by the means 111 formed by minute hand 2 and hour hand 3. According to this embodiment however, the intrinsic acoustic signal frequency 19 is continuously displayed by minute hand 2, opposite a scale of notes, without any comparison having been made during the note identification process 20 to determine the closest note 11. Thus, this hand 2 can point to any value and not only the discrete note values indicated on scale 6 at the edge of the dial. According to this variant, the hour hand 3 consists in a kind of "zoom" of minute hand 2, for which no discrete value has been identified. Reading is thus more intuitive, on the one hand, since the minute hand already intrinsically contains accuracy data, in addition to data about the closest note 11, and on the other hand, the processing steps are saved in the note identification process, since it is no longer necessary to make the value discrete. As in the FIG. 3 variant, indicators 7, target zone 8, and the scale of notes are located in an identical manner on the dial. However it would be possible to reverse the position of graduations 7 and the scale of notes, or to use a larger angular portion of the dial, for example 270 degrees or more, or even the entire dial to spread out scale of notes 6 so as to enable the first intrinsic data concerning the frequency value of signal 10 to be read better immediately, owing to the larger angular portion available for the display of each semitone. The various buttons 16, 17 and 18 and the function thereof are not described for this Figure since they are identical in every way to those illustrated in FIG. 3.

In a more basic variant for the display of intrinsic frequency 19 of signal 10, the two hour and minute hands 3 and 2 could be superposed during display of the detected frequency and both point to a value read on a scale of notes 6. However, this variant requires the user to appreciate the accuracy without using any other indicator 7.

FIG. 6 illustrates another embodiment of the invention, wherein the angular position of notes 11 on scale of notes 6, this time arranged on bezel 5 and not on the dial, coincides with that of the hours. The angular distribution for all of the notes is 360 degrees, i.e. 30 degrees per semitone. Thus this variant can be used not just in the display of the closest note 11, according to the embodiments illustrated in FIGS. 1 to 4, but also advantageously in the continuous display method of FIG. 5, given the enlarged angular space for each semitone. Moreover, the coincident display of the notes of the scale of notes and of the hour allows information concerning the hours to be replaced by notes, without thereby losing the intuitive nature of reading in normal mode, whereas the tuning mode does not require any additional data to be placed elsewhere on the dial. According to this variant, it will be noted that the buttons have been replaced by a crown 9 for making the adjustments and mode changes.

An important difference between the variant of FIG. 6 and the other illustrated embodiments consists in the fact that the minute hand 2, which may moreover be superposed on hour hand 3, can display a calibration value 14, which may preferably range between 435 and 445 Hz, for example depending on the preferences of the user according to the acoustic context and the desired sound effects. The reference frequency 13 is calibrated by default at 440 Hz, which is the nominal value, and may preferably be adjusted downwards or upwards in steps of 1 Hz. However, crown 9 could allow continuous adjustment of calibration values 14. These operations on calibration values 14 have an impact on the calculation of the intrinsic frequencies 19 of electro-acoustic signal 10.

The calibration value is displayed on a calibration value scale 15, arranged opposite one of hands 2 or 3, preferably minute hand 2, preferably on the bottom half of the dial, so as to leave space available for a note accuracy indicator 7, in a similar manner to the variants previously described.

Although the variant of FIG. 6 uses a crown 9 for adjusting the calibration value 4, it is possible to envisage using push buttons 16 and 17, as in FIG. 3, to increment or decrement calibration values 14.

The variants illustrated in FIGS. 7*a* to 7*d* are other possible variants according to the invention, which all have in common the arrangement of a scale of notes on the watch bezel 5, and the use of a crown 9. Moreover, all of these variants use minute hand 2, and not the hour hand, unlike the previously described variants, to display the accuracy of the notes. Minute hand 2 indicates the frequency deviation 12 opposite an indicator 7 formed by graduations on an arc of a circle on the top half portion of the dial, preferably centred at midday and extending over an angle preferably comprised between 120 and 180 degrees.

Variant 7*a* adopts the same scale of notes 6 as that illustrated in FIG. 6 representing the notes in mixed flat/sharp mode over the entire periphery of bezel 5. This is a totally analogue display mode, in conformity with the embodiment of FIG. 3. Likewise, FIG. 7*b* also concerns an embodiment wherein the display is totally analogue, minute hand 2 and hour hand 3 both have the same functions as in FIG. 7*a*, but the note display mode on the scale of notes 6 is simply a dual flat and sharp mode, i.e. all the notes are displayed, when a choice is possible, both as the sharp of the lower note or the flat of the higher note.

Figure 7A:
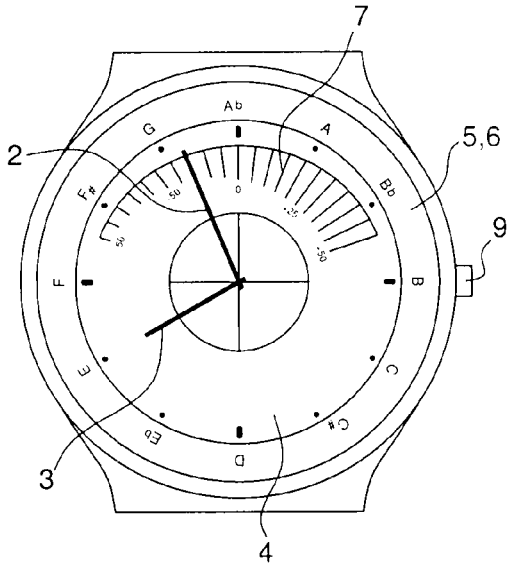
FIGS. 7*a*, 7*b*, 7*c* and 7*d* illustrate different variants for the display of the notes of the tempered scale.
Figure 7B:
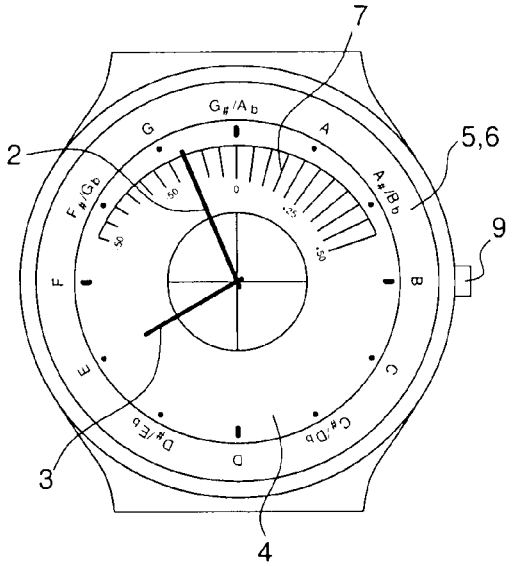
Figure 7C:
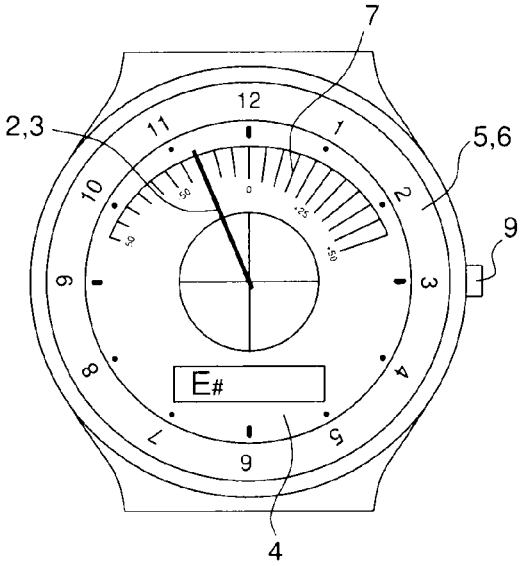

FIG. 7*c* concerns a hybrid display mode, which uses a digital display for the notes 11 closest to the acoustic signal. Bezel 5 can thus again include the numbers of the hours instead of the places of the notes in the variants of FIGS. 7*a* and 7*b*. The digital display means 116 is preferably an LCD screen located on the bottom portion of the dial.

Figure 7D:
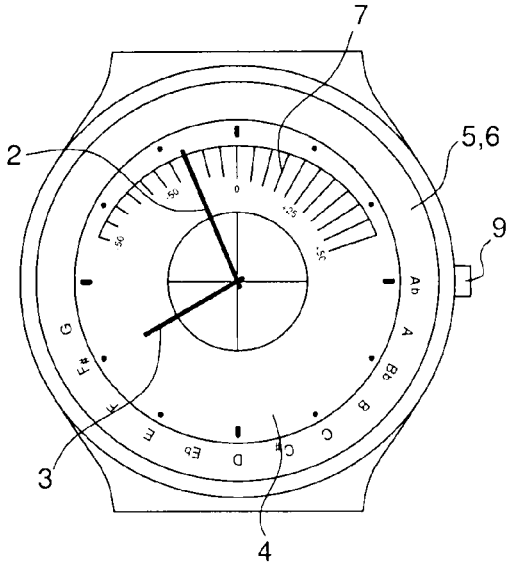

FIG. 7*d* again concerns an analogue display embodiment, which differs from the embodiments of FIGS. 7*a* and 7*b* as regards the arrangement of the notes on the bezel, the scale of notes 6 being located on the bottom portion of bezel 5, between 3 o'clock for the note Ab (A flat) and half past eight for the note G. The scale of notes 6 is not, therefore, centred, given that the twelve semitones associated with the notes follow each other with no indication provided if it has not been possible to identify a frequency during note identification process 20.

Figure 8:
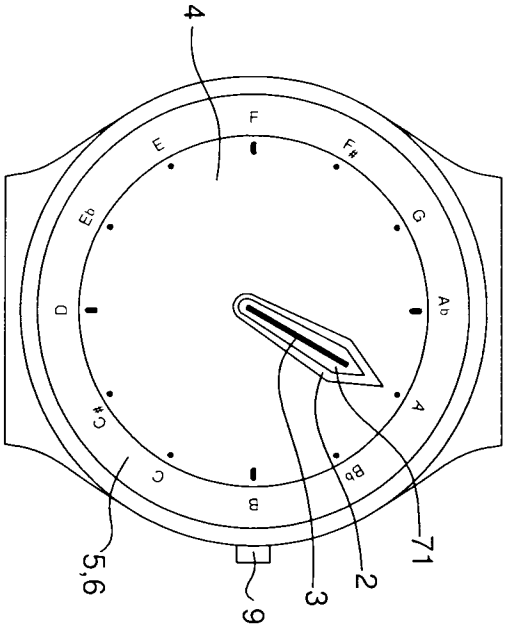
FIG. 8 illustrates a variant for displaying the accuracy of the detected note.

FIG. 8 illustrates an embodiment which displays the accuracy of the note using a reading of the position of hour hand 3 relative to minute hand 2, thus dispensing with the need for a dedicated accuracy indicator 7. According to this embodiment, the closest note 11 is displayed by the minute hand 2 which points to a note on the scale of notes 6, distributed here over the entire angular sector of bezel 5. The accuracy of the note is then displayed by hour hand 3 which is positioned in an angular sector having an amplitude of 30 degrees around the minute hand 2. The maximum deviation for hour hand 3 is 15 degrees on both sides of minute hand 2. According to this variant, this deviation in fact corresponds to a quarter tone, since each semitone occupies an angular space of 30 degrees. The accuracy of a note is thus confirmed by the superposition of the two hands 2, 3 on one of the notes of scale 6, here on the A at one o'clock on dial 4.

Given the reduced angular space for indicating note accuracy compared to the other embodiments of the invention, specific shapes or specific colours could be used, for example green for the hands displaying the notes and the hand displaying accuracy, regardless of whether it is hour hand 3 or minute hand 2 (the function of each could be reversed), and superposing the hands so that the colour indicating accuracy, for example red, is hidden by the colour, for example green, indicating the note when the frequencies tally. As regards shape, a hollow hand could for example be favoured, preferably minute hand 2, which is larger than hour hand 3. Hour hand 3 is then housed in the hollow 71 in minute hand 2 when the frequencies tally. This variant has the advantage of not overloading dial 4 with accuracy data, thereby freeing place for other types of data. However it has the drawback of higher machining costs for the hollow hand, which is more difficult to make than a standard hand.

The variant of FIG. 8 is illustrated with a crown 9 for changing mode. It will however be clear that it is entirely possible to envisage this variant with push buttons according to the embodiments of FIGS. 3 and 5.

More generally, the various embodiments described are given by way of example and should in no event be interpreted in a limiting manner. It is for example possible to envisage combining the features of the various embodiments described, or even to add others, known to those skilled in the art, without departing from the scope of the invention.

LIST OF REFERENCES

| | |
|---|---|
| 1 | Portable timepiece |
| 2 | Minute hand |
| 3 | Hour hand |
| 4 | Dial |
| 5 | Bezel |
| 6 | Scale of notes |
| 61 | Mark indicating that no note has been identified |
| 7 | Note accuracy indicator |
| 71 | Hollow |
| 8 | Target zone |
| 9 | Crown (FIG. 6) |
| 10 | Received electro-acoustic signal |
| 11 | Closest note to the received note |
| 12 | Frequency deviation |
| 13 | Reference frequency of the tuner |
| 14 | Reference frequency calibration value |
| 15 | Scale of calibration values |
| 16 | First push button |
| 17 | Second push button |
| 18 | Third push button |
| 19 | Intrinsic acoustic signal frequency |
| 100 | Electronic device |
| 101 | Acoustic signal sensor |
| 102 | Electro-acoustic signal processing means |
| 1021 | Filter |
| 1022 | Amplifier |
| 1023 | Comparator |
| 103 | Microcontroller |
| 104 | Base clock |
| 105 | RC oscillator |
| 106 | Supply current |
| 107 | Battery |
| 108 | Binary signal (pulse train) |
| 109 | Data memory |
| 110 | Programme memory |
| 111 | Analogue display means |
| 112 | Means for the user interface |
| 113 | Processor (CPU) |
| 114 | Motor module |
| 115 | Input/output interface of the microcontroller |
| 116 | Digital display means |
| 20 | Musical note identification process |

-continued

| | |
|---|---|
| 21 | Musical note period table |
| 22 | Binary signal period |
| 231 | First series of periods acquired by the microcontroller |
| 232 | Second reduced series of samples higher than a threshold |
| 233 | Third series determined from the first two series |
| 234 | Fourth series sorted from the third series |
| 24 | Identified period |
| 25 | Correction factor |
| 26 | Measured period |
| 201 | RC oscillator (105) frequency calibration |
| 202 | Measurement of binary signal periods 108 |
| 203 | Fundamental period extraction process |
| 2031 | Comparison relative to a determined threshold |
| 2032 | Calculation of the duration between peaks higher than the |
| 2033 | Sorting of elements of series 233 |
| 2034 | Threshold comparison |
| 2035 | Threshold decrementation |
| 204 | Identification of the fundamental period |
| 2041 | Verification that a period has been obtained |
| 205 | Note accuracy calculation |
| 206 | Failure of fundamental frequency extraction process |
| 207 | Step of comparing the measured period with notes |

The invention claimed is:

1. A portable timepiece, provided with at least one hand for displaying the minutes and/or the hours, said portable timepiece comprising:

an electronic unit for the chromatic tuning of an instrument, said electronic unit including an acoustic signal sensor and a means of processing the received electro-acoustic signal, at least one of said hands displaying a note the frequency of which is closest to that of the received signal and a relative frequency deviation between said note and said received signal, wherein said timepiece includes an indicator for displaying the accuracy of said notes opposite the hour hand in a top half portion of a watch dial and a scale of notes arranged opposite the minute hand in a bottom half portion of the dial, so that the data concerning the pitch of the closest note and the accuracy of the note are totally separate.

2. The portable timepiece according to claim 1, wherein at least one of said hands also displays a calibration value of a reference frequency of the tuner.

3. The portable timepiece according to the claim 2, further including a first push button for incrementing said calibration value and a second push button for decrementing said calibration value.

4. The portable timepiece according to claim 2, further including a scale of calibration values opposite one of said hands.

5. The timepiece according to claim 4, wherein said indicator displays a tone ranging from a quarter tone below to a quarter tone above said closest note.

6. The portable timepiece according to claim 4, wherein it further includes a target zone relative to the frequency of said closest note.

7. The portable timepiece according to claim 4, wherein said scale is located on the periphery of the dial or on the bezel of said timepiece.

8. The portable timepiece according to claim 7, further including a third push button for changing mode and validating adjustments.

9. A display method for a chromatic tuner using the portable timepiece according to claim 1.

10. The display method according to claim 9, wherein the intrinsic frequency of said received electro-acoustic signal is continuously displayed by the minute hand opposite a scale of notes and a frequency deviation is indicated between the closest note and said frequency of said electro-acoustic signal.

11. The display method according to claim 9, wherein the accuracy of the notes is indicated by the relative position of the hour hand with respect to the minute hand.

* * * * *